US006896257B2

(12) United States Patent
Yamashita et al.

(10) Patent No.: US 6,896,257 B2
(45) Date of Patent: May 24, 2005

(54) SHEET FEEDING APPARATUS

(75) Inventors: Masashi Yamashita, Koufu (JP); Hideki Aoyagi, Koufu (JP); Atsumi Kobayashi, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 24 days.

(21) Appl. No.: 10/662,454

(22) Filed: Sep. 16, 2003

(65) Prior Publication Data

US 2004/0080098 A1 Apr. 29, 2004

(30) Foreign Application Priority Data

Sep. 17, 2002 (JP) ..... 2002-270806

(51) Int. Cl.[7] ..... B65H 9/04
(52) U.S. Cl. ..... 271/242; 399/372
(58) Field of Search ..... 271/242; 399/372

(56) References Cited

U.S. PATENT DOCUMENTS 5,681,036 A * 10/1997 Wakahara et al. ..... 271/10.12
5,738,349 A * 4/1998 Shirasaki ..... 271/242
5,775,690 A * 7/1998 Quesnel et al. ..... 271/242
6,032,949 A * 3/2000 Ando ..... 271/225
6,786,480 B2 * 9/2004 Lee et al. ..... 271/10.12
6,805,347 B2 * 10/2004 Kuramoto ..... 271/242

OTHER PUBLICATIONS

Patent Abstract of Japan, No. 2000–203729, publication date Jul. 25, 2000, Applicant Kyocera Mita Corp.

* cited by examiner

*Primary Examiner*—David H. Bollinger
(74) *Attorney, Agent, or Firm*—Manabu Kanesaka

(57) ABSTRACT

A sheet feeding apparatus includes a stacking tray for stacking a sheet, a sheet feeding device for feeding the sheet, a register device for aligning a leading edge of the sheet fed by the sheet feeding device, a recognition device for recognizing a state that the sheets stacked on the stacking tray have different widths, and a setting device for setting a feeding distance according to a result of the recognition device. A control device controls the sheet feeding device to feed the sheet for the feeding distance.

14 Claims, 10 Drawing Sheets

SHEET FEEDING APPARATUS

BACKGROUND OF THE INVENTION AND RELATED ART STATEMENT

The present invention relates to a sheet feeding apparatus for feeding a sheet to a predetermined position. More specifically, the present invention relates to a sheet feeding apparatus having register means for correcting a skew of a sheet by contacting a leading edge of the sheet for alignment.

In a conventional sheet feeding apparatus, a draw roller picks up sheets stacked on a stacking tray. A separating device composed of a sheet feed roller and a separation member separates the sheets into a single sheet, and sends the single sheet to a pair of register rollers. The sheet feed roller feeds the sheet to abut against a nipping portion of the register rollers to form a loop having a predetermined size for correcting a skew of the sheet.

Japanese Patent Publication (Kokai) No. 2000-203729 has disclosed a sheet feeding apparatus in which a sheet is transported for a predetermined distance to a pair of register rollers for correcting a skew when sheets having a same size are stacked on a stacking tray.

When such a sheet feeding apparatus feeds the sheet having the same size, the sheet is transported in a state that side regulating plates on the stacking tray regulate both side edges of the sheet in a width direction. Therefore, it is possible to reduce a variation in the skew in the width direction. When the sheet feeding apparatus feeds sheets having different sizes, it is difficult to regulate a sheet having a size other than the maximum size with the side regulating plates. As a result, when the sheet feeding apparatus feeds the sheets having the different sizes, as opposed to the case of feeding the sheets with the same size, it is difficult to reduce the variation in the skew and properly correct the skew depending a size of the sheet.

In particular, in a sheet feeding apparatus in which the sheets are stacked based on a center of the sheets in the width direction, a draw roller and a sheet supply roller are arranged at a center portion of the apparatus in the width direction of the sheet. Accordingly, when the sheet having a size different from the maximum size is fed, the draw roller and sheet feed roller contact the sheet at a position shifted from the center thereof in the width direction, resulting in a large skew with great frequency. Therefore, it is possible to damage the sheet or feed the sheet improperly, thereby causing a problem.

In view of the problems described above, the present invention has been made, and an object of the present invention is to provide a sheet feeding apparatus in which a skew of a sheet can be corrected even when the sheet stacked on a stacking tray is not regulated properly with side regulating plates.

Further objects and advantages of the invention will be apparent from the following description of the invention.

SUMMARY OF THE INVENTION

To attain the objects described above, according to the present invention, a sheet feeding apparatus includes a stacking tray for stacking a sheet, sheet feeding means for feeding the sheet, register means for aligning a leading edge of the sheet fed by the sheet feeding means, recognition means for recognizing a state that the sheets having different widths are stacked on the stacking tray, setting means for setting a feeding distance or amount according to a result of the recognition means, and control means for controlling the sheet feeding means to feed the sheet for the feeding distance.

According to the present invention, a sheet feeding apparatus may include receiving means for receiving a mixed size mode signal to feed the sheets having different widths stacked on the stacking tray. The control means controls the sheet feeding means to feed the sheet for a distance larger than a predetermined distance (default) after the detection means arranged at an upstream side of the register means detects a leading edge of the sheet according to the mixed size mode signal.

According to the present invention, a sheet feeding apparatus may include adjusting means for adjusting a distance that the sheet feeding means feeds the sheet after the detection means detects the leading edge of the sheet. The adjusted distance is stored as a normal sheet feeding distance. When the receiving means receives the mixed size mode signal, the control means controls the sheet feeding means to feed the sheet for a distance larger than the normal sheet feeding distance.

DETAILED DESCRIPTION OF PREFERRED EMBODIMENTS

Figure 1:
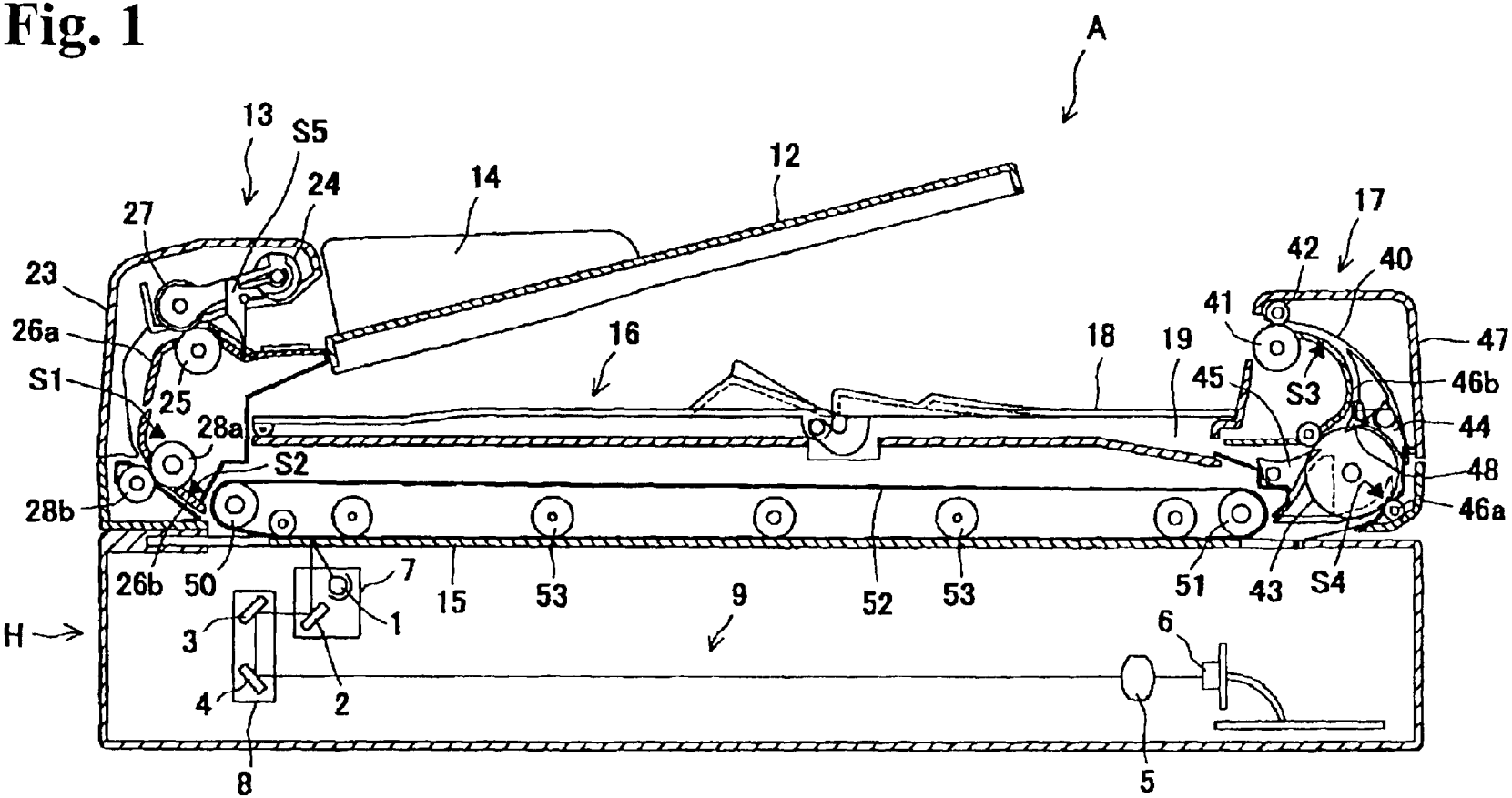
FIG. 1 is a sectional view showing structures of an image reading apparatus and an automatic sheet feeding apparatus.
Figure 2:
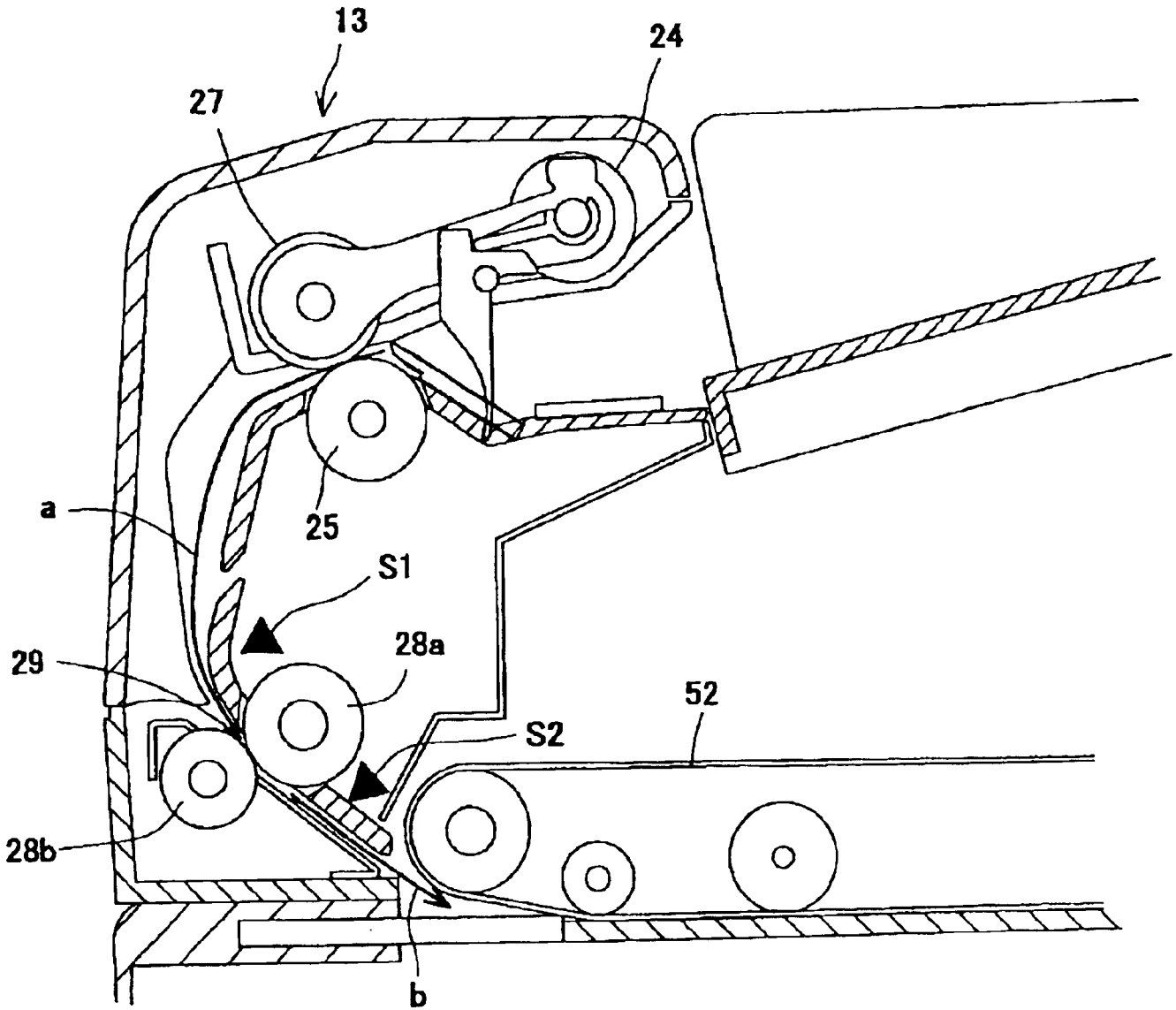
FIG. 2 is an enlarged view showing a structure of a sheet feeding portion of the automatic sheet feeding apparatus.
Figure 3:
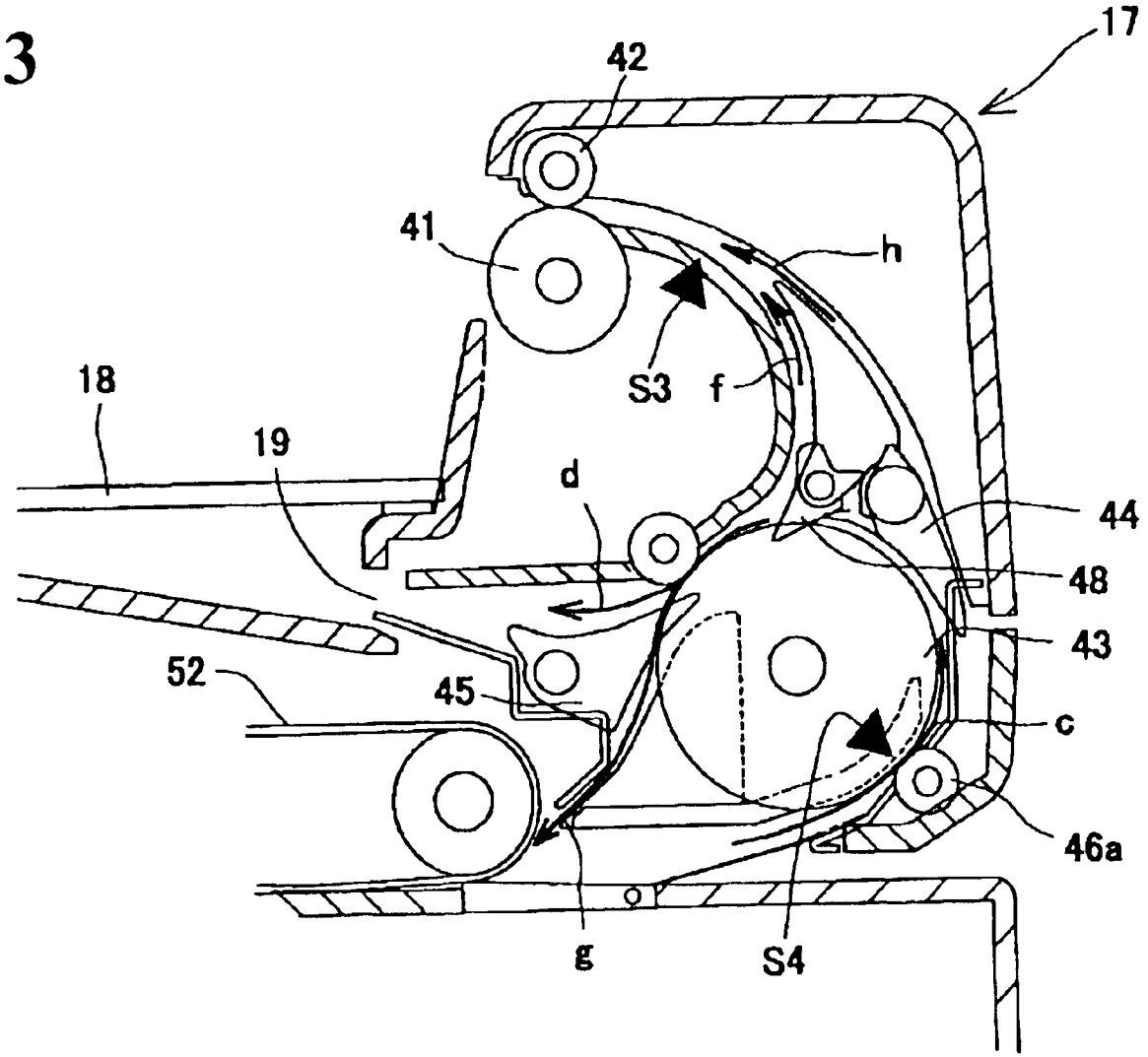
FIG. 3 is an enlarged view showing a structure of a turn over/discharge unit of the automatic sheet feeding apparatus.
Figure 4:
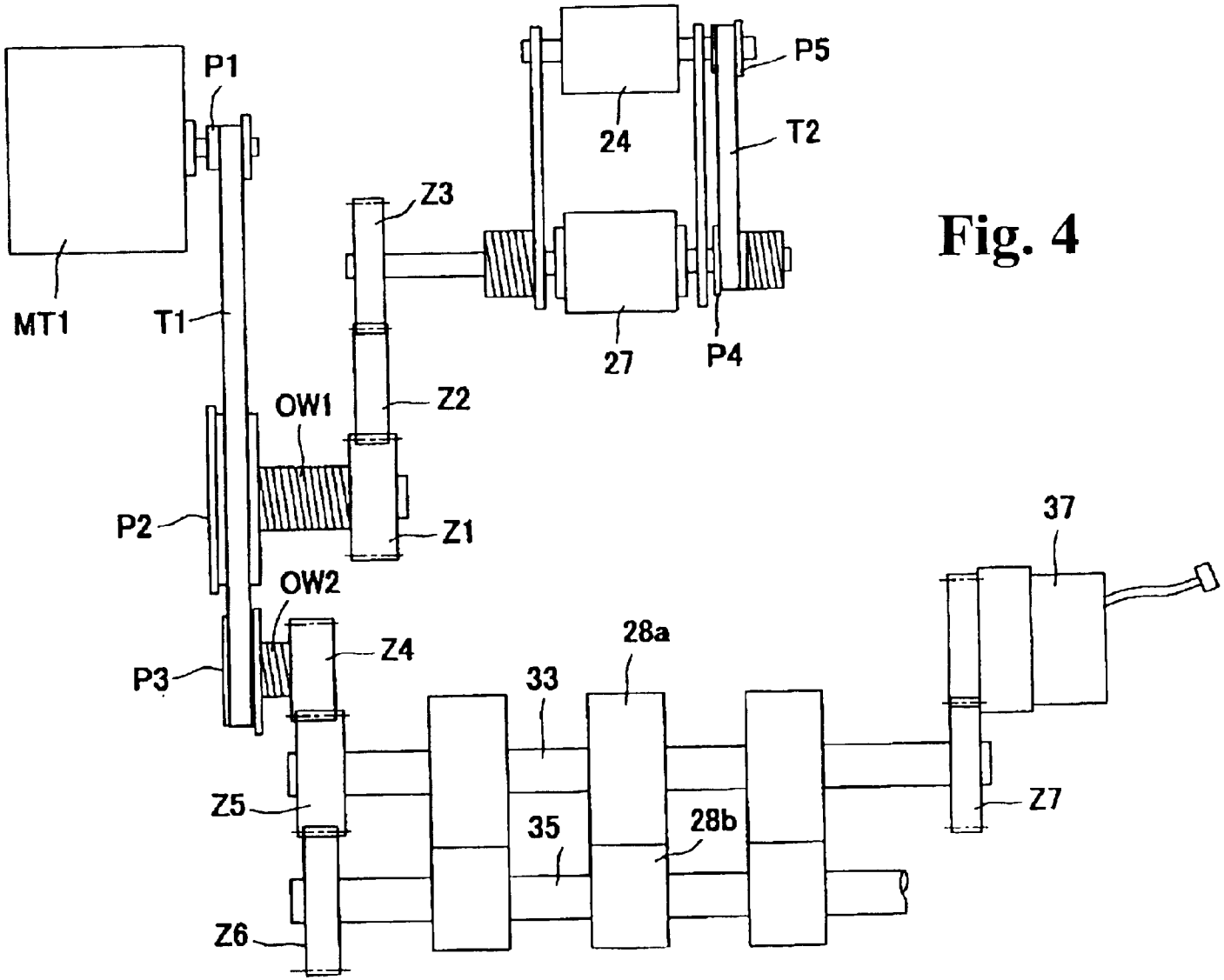
FIG. 4 is a view showing a drive system of the automatic sheet feeding apparatus.

Hereunder, embodiments of the present invention will be explained with reference to the accompanying drawings. FIG. 1 is a sectional view showing structures of an image reading apparatus H and an automatic sheet feeding apparatus A. FIG. 2 is an enlarged view showing a structure of a sheet feed unit 13 of the automatic sheet feeding apparatus A. FIG. 3 is an enlarged view showing a structure of a turn over/discharge unit 17 of the automatic sheet feeding apparatus A. FIG. 4 is a view showing a drive system of the sheet feeding unit 13 of the automatic sheet feeding apparatus.

As shown in FIG. 1, the image reading apparatus H comprises reading means 9 having a reduction optical system in which a light source 1 such as a lamp radiates light onto an original or a sheet placed on a platen through a platen 15, and a CCD 6 reads reflected light through a plurality of mirrors 2, 3 and 4 and a lens 5. In the reading means 9, a first carriage 7 comprising the light source 1 and the mirror 2, and a second carriage 8 comprising the mirrors 3 and 4 move in a sub-scanning direction to read an image on the original placed on the platen 15.

The automatic document feeding apparatus A comprises a sheet feeding tray 12 for stacking the original; a discharge tray 18 for stacking a discharged original; the sheet feed unit 13 for feeding the original stacked on the sheet feeding tray 12 to the platen 15 on the image reading apparatus H; a transport unit 16 for receiving the sheet from the sheet feed unit 13 and transporting the sheet to a predetermined position on the platen 15; and a turn over/discharge unit 17 for turning over the sheet from the platen 14 and returning the sheet to the platen 15, or discharging the sheet to the discharge tray 18 after reading the image.

The sheet feeding tray 12 includes a flat member inclined downwardly in a direction that the original is fed, and a pair of regulating plates 14*a* and 14*b* is disposed slidably in a lateral direction at right and left sides of the sheet feeding tray 12 for regulating the original in a width direction.

Figure 8A:
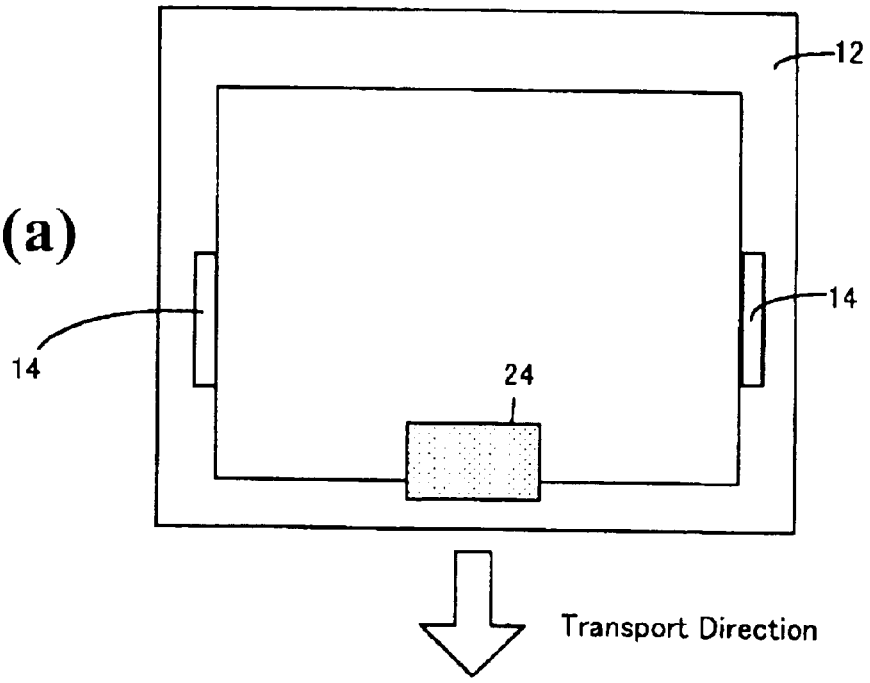
FIGS. 8(*a*) and 8(*b*) are views showing a process of placing an original on a sheet stacking tray.
Figure 8B:
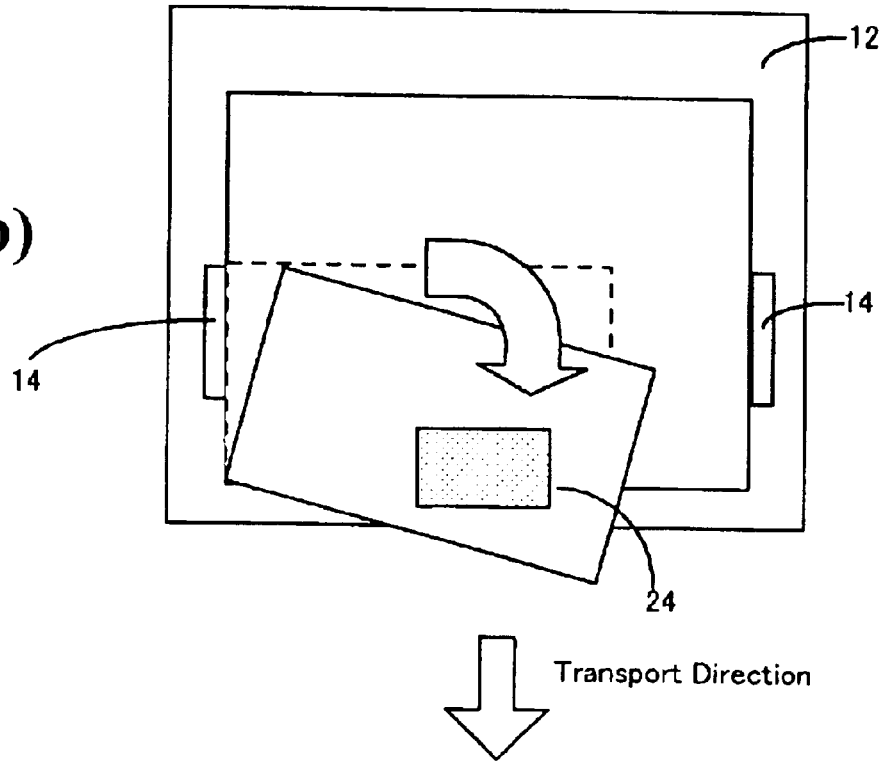

In a normal mode in which the sheets having a same size are stacked on the sheet feeding tray 12, the sheets are placed with a center thereof in the width direction as a reference (center reference method), as shown in FIG. 8(*a*). In a mixed size mode in which the sheets having differing sizes are stacked on the sheet stacking tray 12, a sheet having the largest size is placed with the center reference, and sheets having other sizes are placed with a side of the largest sheet as a reference, as shown in FIG. 8(*b*). In other words, in the mixed size mode, the sheets having the other sizes are placed with the reference according to the maximum size of the sheet.

In the mix size mode, the sheets having the other sizes are placed with the side of the largest sheet as the reference, thereby making it easy to place and handle the sheets with different sizes. However, the draw roller contacts the sheets with the other sizes at a position shifted from a center thereof in the width direction, thereby causing a skew of the sheet, as shown in FIG. 8(*b*).

As shown in FIGS. 1 and 2, the sheet feed unit 13 of the automatic document feeding apparatus A comprises a cover 23; the draw roller 24 for drawing the sheet stacked on the sheet feeding tray 12; the feed roller 27 for feeding the sheet; a separation roller 25 contacting the feed roller 27 for feeding the sheet one by one; sheet supply guides 26*a* and 26*b* for guiding the sheet, and a pair of register rollers 28, or register means, for correcting the skew through contacting a leading edge of the sheet.

A pair of the register rollers 28 is composed of a register roller 28*a* and a pinch roller 28*b*. The draw roller 24 and sheet feed roller 27 are arranged substantially at a center of the sheet in the width direction. A plurality of pairs of the register rollers 28 is arranged in the width direction with a predetermined interval. Register sensors S1 for detecting a leading edge of the sheet and timing sensors S2 for controlling the feeding of the sheet are arranged at front and rear sides of the register rollers 28*a*.

As shown in FIG. 3, a sheet feed motor MT1 capable of rotating in both directions is disposed in a drive system of the sheet feed unit 13 for driving each of the rollers described above. A timing belt T1 transmits drive of the sheet feed motor MT1 to pulleys P2 and P3. A one-way clutch OW1 transmits the drive to a plurality of gears Z1, Z2 and Z3 to rotate the sheet feed roller 27 only when the sheet feed motor MT1 rotates forward. A timing belt T2 transmits the drive from a pulley P4 to a pulley P5 to rotate draw roller 24. A one-way clutch OW2 transmits the drive to gears Z5 and Z6 via a gear Z4 to rotate the register rollers 28*a* the pinch rollers 28*b* only when the sheet feed motor MT1 rotates in reverse.

In this embodiment, a solenoid clutch 37 is disposed as break means engaging a gear Z7 disposed at an end of a support shaft 33 of the register rollers 28*a*. When the register rollers 28*a* stop and the solenoid clutch 37 is activated, the solenoid clutch 37 completely locks the support shaft 33, so that the register rollers 28*a* are securely locked. The support shafts 33 and 35 are interconnected through the gears Z5 and Z6, so that the register rollers 28*b* are also securely locked.

The transport unit 16 comprises a drive roller 50 disposed at an upstream side of the platen 15; a follower roller 51 disposed at a downstream side of the platen 15; and a transport belt 52 trained therebetween. A transport motor MT2 drives the drive roller 50. A plurality of pressure rollers 53 is disposed for accurately transporting the sheet to the platen 15 to perform fine reading of an image.

As shown in FIGS. 1 and 3, the turn over/discharge unit 17 comprises a discharge guide 40 for guiding the sheet discharged from the platen 15; a pair of discharge rollers 41 for transporting the sheet to the discharge tray 18; a discharge sensor S3 and a turn-over sensor S4 for detecting an edge of the sheet discharged; a turn-over roller 43 for turning over the sheet; a discharge flapper 44 for switching a path for discharging the sheet; a turn-over flapper 45 for switching a path of turning over the sheet; and pinch rollers 46*a* and 46*b* for pressing the sheet against the turn over roller 43. A discharge cover 47 covers an entire portion of the turn over/discharge unit 17. A discharge motor MT3 drives the discharge roller 41 and turn over roller 43.

A free-falling flapper 48 hangs downwardly by own weight, and is configured to rotate upwardly when the sheet passes therethrough and a leading edge thereof pushes. The discharge roller 41 comprises a drive mechanism to rotate only in one direction regardless of the forward or reverse rotation of the discharge motor MT3.

Figure 5:
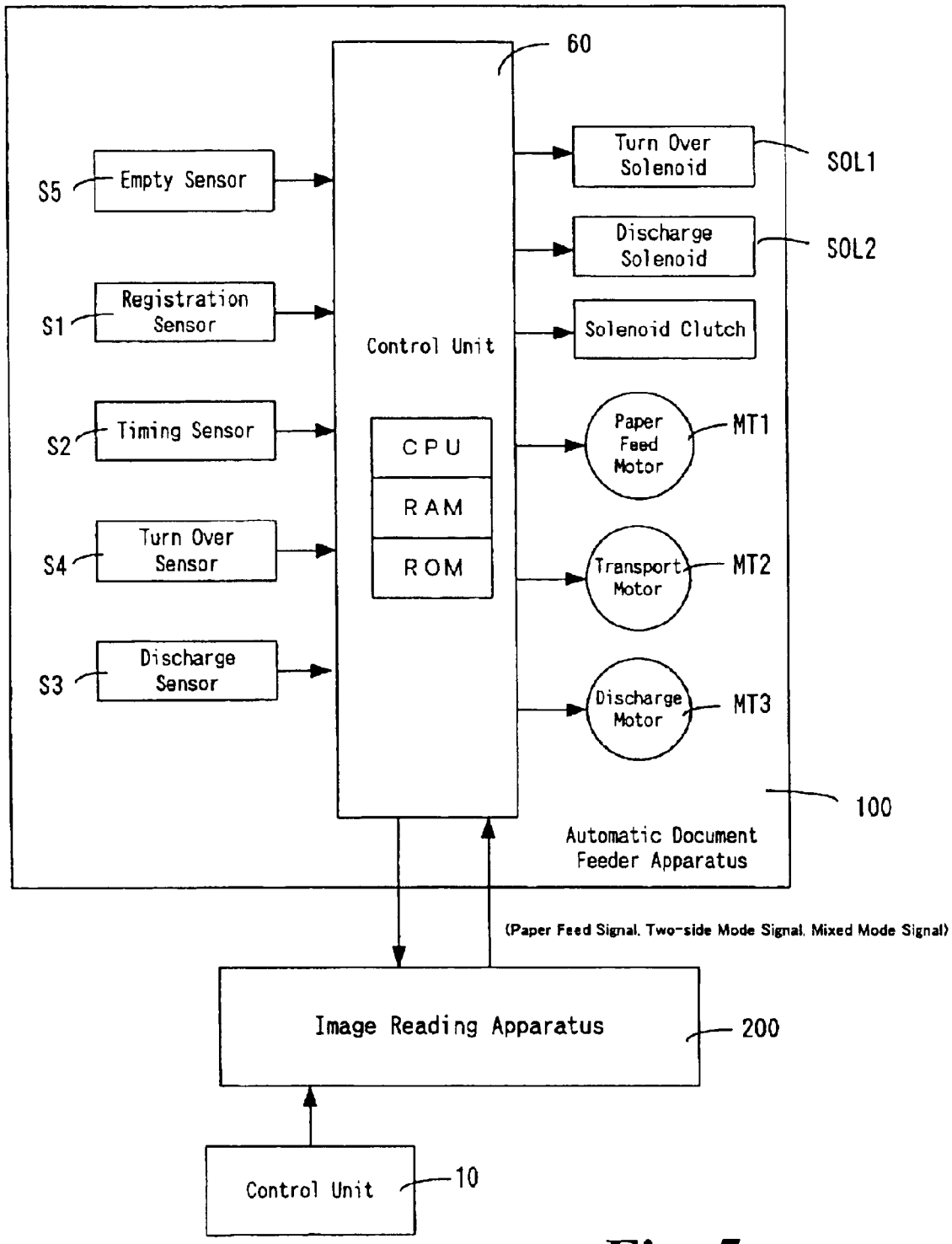
FIG. 5 is a block diagram showing a configuration of the image reading apparatus and automatic sheet feeding apparatus.

As shown in FIG. 5, the automatic document feeding apparatus A receives a signal corresponding to a processing mode such as a single side mode, a double side mode, and a mixed size mode input through an operation panel 10 on the image reading apparatus H to control the feeding of the original or sheet according to the mode signal.

Each of the sensors S1 to S5 is connected to the control unit 60 to control the transport of the original. A CPU performs a control program as control means according to signals output from the sensors for controlling the motors and the solenoids SOL1 and SOL2 to feed the original according to each mode.

The control unit comprises the CPU; ROM and RAM as memory means for storing various data and the control programs; an input interface circuit as receiving means for receiving information data such as the single side mode, double side mode and mixed size mode from the image reading apparatus H; an output circuit for sending information from the automatic document feeding apparatus 100 to the image reading apparatus H; and a drive circuit for driving the motors and the solenoids SOL1 and SOL2.

In the embodiment, the operation panel 10 for inputting the modes is disposed on the image reading apparatus. Alternatively, the operation panel 10 is disposed on the automatic document feeding apparatus, an image forming apparatus, an image reading apparatus such as a PC, or a device other than the automatic document feeding apparatus.

Figure 6:
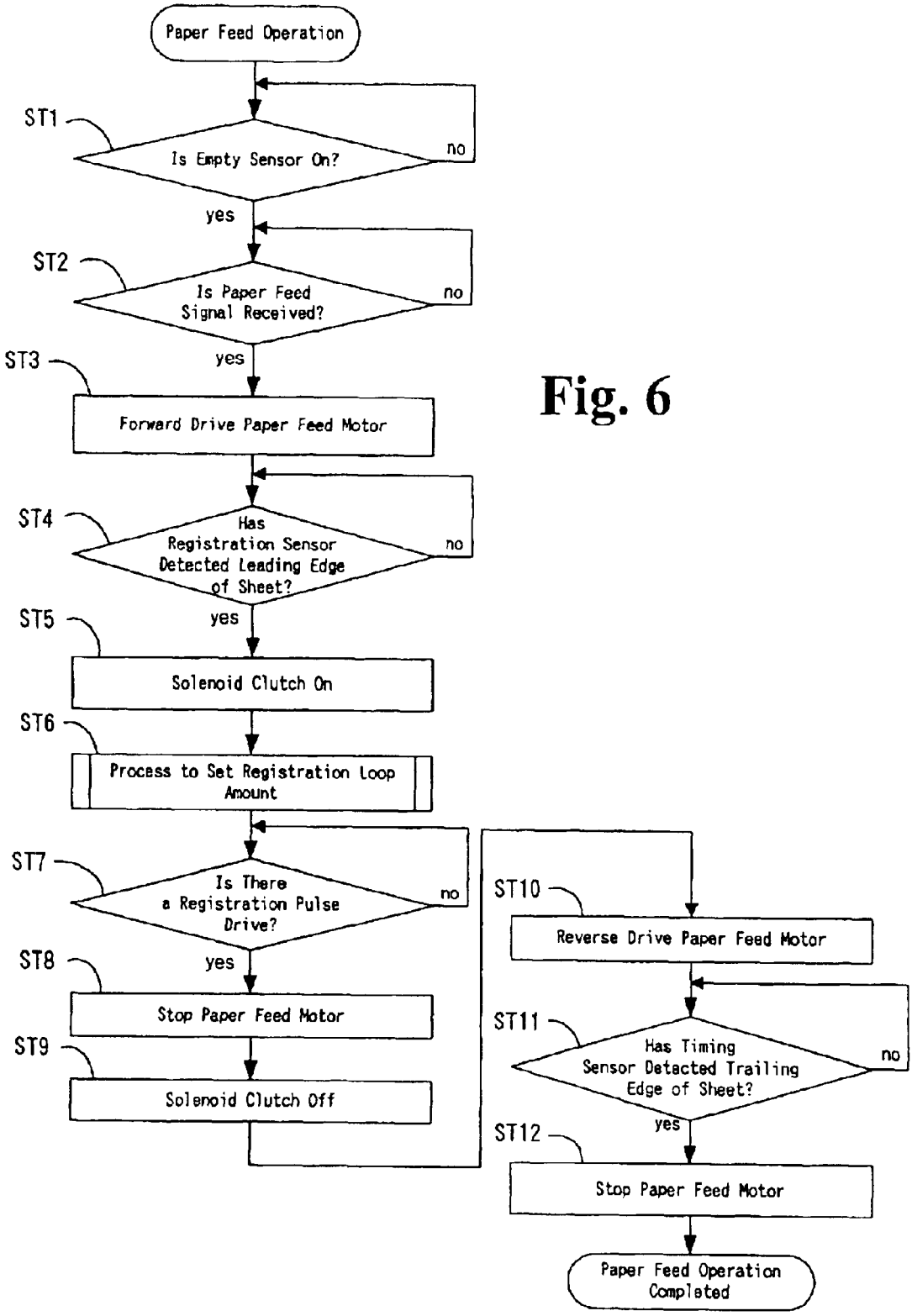
FIG. 6 is a flowchart showing an operation of feeding a sheet.

Operations of feeding, transporting and discharging the sheet in the automatic document feeding apparatus A composed of the structure described above will be explained next. An operation of feeding the sheet will be explained in reference to a flow chart shown in FIG. 6.

The empty sensor S5 detects the original (ST1) and the paper feed motor MT1 rotates in forward when the paper feed signal is received from the image reading apparatus H (ST2). The draw roller 24 and paper feed roller 27 rotate (ST3). The original is drawn by the draw roller 24 in the arrow direction a in FIG. 2, and is then separated into the single sheet by the paper feed roller 27 and the separating roller 25 so that the single sheet is supplied.

When the register sensor S1 detects the leading edge of the sheet (ST4), the solenoid clutch is activated (ST5). In the control unit 60, an amount of feeding for the register is set (ST6). The paper feed motor MT1 is driven only for an amount of register drive pulse corresponding to the amount of feeding for the register (ST7), and then is stopped (ST8). The leading edge of the sheet abuts against the register roller 28*a* at a portion thereof contacting the register pinch roller 28*b* (the nipping point 29) to form a loop and align the leading edge of the sheet to remove any skew.

The amount of feeding for the register is an amount of feeding the sheet by the paper feed roller 27 after the leading edge abuts against the register rollers 28 after the register sensor S1 detected the leading edge of the sheet. The amount of feeding for the register determines a size of the register loop formed until the paper fed by the paper feed roller 27 stops after the leading edge of the sheet abuts against the register rollers 28.

Figure 7:
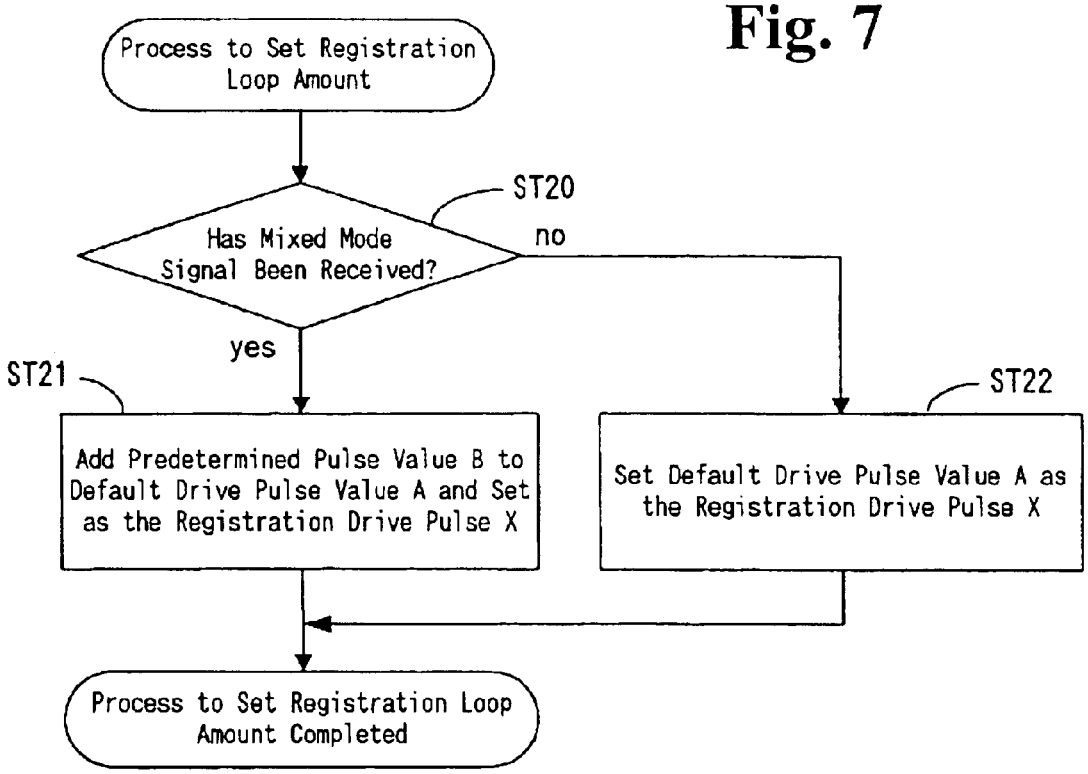
FIG. 7 is a flowchart showing a process of setting a sheet feeding distance in the operation of feeding the sheet.

In a process of setting the register feed amount (explained in detail later), as shown in FIG. 7, it is confirmed whether the mixed size mode signal is received from the image reading apparatus (ST20). If it is the case, a predetermined pulse value B is added to a default drive pulse value A to be as a register drive pulse value (ST21). If the mixed size mode signal is not received, it is recognized to be the normal mode and the regular default drive pulse value A is set as the register drive pulse value (ST22).

When the original is fed, the solenoid clutch 37 is operated to lock the register roller 28*a* and the register pinch roller 28*b*. Accordingly, the leading edge of the sheet does not rotate the register roller 28*a* and the register pinch roller 28*b*, so that the skew of the original is securely removed.

When the register process described above is securely performed, the paper feed motor MT1 stops (ST9), and the solenoid clutch 37 is released after a predetermined amount of time. The paper feed motor MT1 is driven in reverse (ST10) to rotate the register roller 28*a* and feed the original to the platen 15 in the arrow direction b in FIG. 3. When the timing sensor S2 detects the trailing edge of the original (ST11), the paper feed motor MT1 is stopped to complete the paper feed operation.

In the transport operation, when the paper feed motor MT1 is driven in reverse, the transport motor MT2 is driven forward to rotate the transport belt 52, so that the original sent from the register rollers 28 is fed along the platen 15. When the timing sensor S2 detects the trailing edge of the original, the paper feed motor MT1 is stopped after transporting the original for a predetermined amount. The register roller 28*a* and the transport belt 52 stop, and the original is stopped at a predetermined position on the platen 15, so that the reading means 9 on the image reading apparatus 14 reads the image on one side of the original (the front side).

After the image on the one side (the front side) of the original is read, the transport motor MT3 is driven forward again and the discharge motor MT2 is driven forward at the same time. The transfer belt 15 is driven forward, and the turn over roller 43 is rotated forward to transport the original from the top of the platen 15. The discharge operation is executed differently according to the single side mode for reading one side of the original or the double side mode for reading both sides of the original.

In the single side mode, the original discharged from the top of the platen 15 is guided to a switchback path 19 through the discharge flapper 44 and the reverse flapper 45, in the arrow directions c and d in FIG. 4. The original is transported for a predetermined distance after the discharge sensor S4 detects the trailing edge thereof. Then, the discharge motor MT3 stops the turn over roller 55 temporarily. The trailing edge of the sheet is nipped by the turn over roller 43 and the pinch roller 56*b* after passing the free-falling flapper 48. The turn over roller rotates in reverse by the reverse drive of the discharge motor MT3 to turn over the original nipped by the turn over roller 43 and the pinch roller 56*b*. The original is switched back and sent to the discharge rollers 41 and 42 in the arrow direction f in FIG. 3. The discharge rollers 41 and 42 discharge the sheet to the discharge tray 18. The next sheet is discharged with the same process. Similarly, the same processes of feeding, transporting and discharging are repeated for the third and fourth sheets.

In the double side mode, after the turn over sensor S4 detects the leading edge of the original discharged from the platen 15, the original is transported for a predetermined distance to pass through the discharge flapper 44 and the free-falling flapper 48. The original stops at a position where the leading edge of the sheet is nipped by the turn over roller 55 and the pinch roller 56*b*, and the transfer motor MT2 and the discharge motor MT3 stop temporarily to stop the original. The transport motor MT2 rotates in reverse at the same time when the turn over flapper 45 switches a direction to guide the original toward the platen 15, and the discharge motor MT3 rotates forward again. The original is turned over from front to back and fed to the platen 15 in the arrow direction g in FIG. 3, and is transported to a predetermined position on the platen 15.

The reading means 9 reads a backside of the original transported to the predetermined position on the platen 15. When the reading is completed, the transport motor MT2 drives forward and the discharge motor MT3 rotates forward at the same time. The transfer belt 52 and the turn over roller 43 rotate forward to transport the original from the top of the platen 15.

When the turn over sensor S4 detects the leading edge of the original transported from the platen 15, the discharge flapper 44 switches to a position to guide the original directly to the discharge rollers 41 and 42 in the arrow direction c in FIG. 3. The discharge rollers 41 and 42 discharge the original to the discharge tray 18. The same process of discharging the sheet is performed to discharge the next sheet. Similarly, the same processes for feeding, transporting and discharging are repeated for the third and fourth sheets.

Figure 9A:
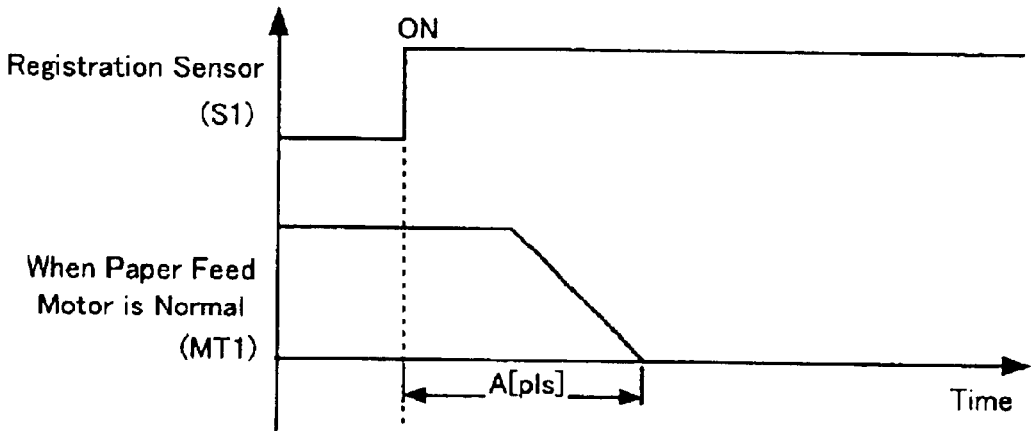
FIG. 9(*a*) is a timing chart of a register control in a normal mode, and FIG. 9(*b*) is a view showing a register loop of a sheet in the normal mode.
Figure 9B:
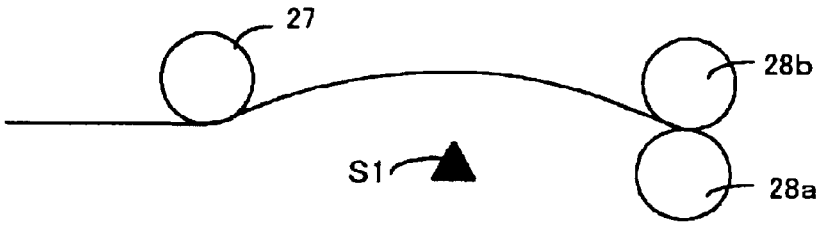

The process of setting the register feeding amount in the feeding operation will be described in detail. As shown in FIG. 7, the register feeding amount is set according to whether the mixed size mode is selected through the operation panel 10 on the image reading apparatus H. If the mixed size mode is not received from the image reading apparatus H, it is recognized to be the normal mode. Thus, the register drive pulse default value A stored in the RAM on the control unit 60 is set as the register feeding amount. As shown in FIG. 9(*a*), when the register sensor S1 detects the leading edge of the sheet, the paper feed motor MT1 is driven for only the amount of the default pulse value A and then stopped to form a loop shown in FIG. 9(*b*).

Figure 10A:
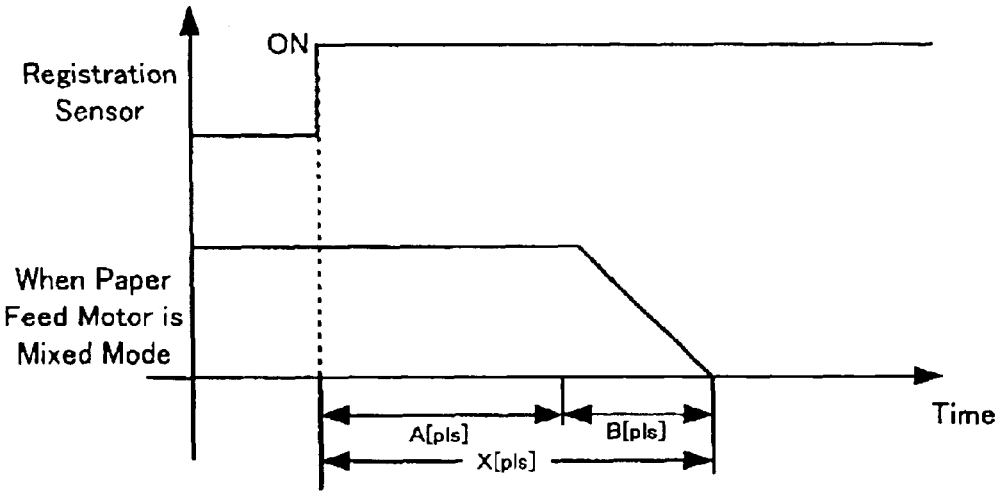
FIG. 10(*a*) is a timing chart of a register control in a mixed size mode, and FIG. 10(*b*) is a view showing a register loop of a sheet in the mixed size mode.
Figure 10B:
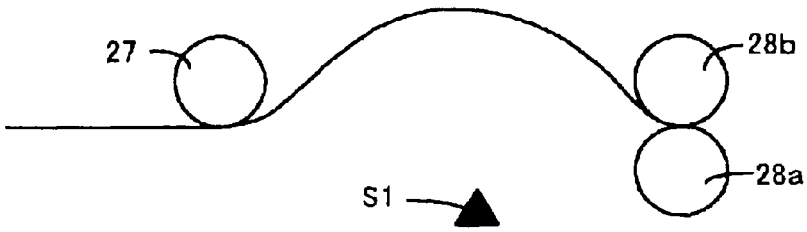

When the register sensor S1 detects the original, if the mixed size signal is received from the image reading apparatus H, the predetermined pulse value B is added to the default value A of the register drive pulse stored in the RAM on the control unit 60 to set a mixed pulse value X as the register feed amount. As shown in FIG. 10(*a*), when the register sensor S1 detects the leading edge of the sheet, the paper feed motor MT1 is driven only for the amount of the mixed size pulse value X to form a register loop larger than that in the normal mode, as shown in FIG. 10(*b*), to securely correct the skew.

The register drive pulse default value A stored in the RAM on the control unit 60 can be adjusted from the operation panel 10 on the image reading apparatus H as follows. First, the register drive pulse default value A is input from the operation panel on the image reading apparatus H. The register drive pulse default value is sent to the control unit 60 on the automatic document feeding apparatus A from the image reading apparatus. In the control unit 60, the register drive pulse default value A input from the operation panel on the image reading apparatus H replaces the register drive pulse default value A stored in the RAM, thereby adjusting the register drive pulse default value.

Through the adjustment of the register drive pulse default value A, it is possible to securely remove the skew even if the sheets have different sizes and is it difficult to align the leading edge of the sheets to remove the skew.

A process of adjusting the default value A is not limited to the one described above. For example, it is possible to store the feed default value A in advance corresponding to a distance L1 from the register sensor to the register rollers in the control unit ROM. The number of pulses corresponding to a distance L2 of feeding the original after the leading edge of the sheet abuts against the nipping portion of the register rollers is input from the operation panel as a pulse value A. The distance data is sent from the image reading apparatus to the control unit on the automatic document feeding apparatus. The control unit converts the distance data to the pulse value A2 and stores the same.

When the register feeding amount is set in the normal mode, the adjusted pulse A2 is added to the feed pulse value A1 to be the register drive pulse A (the default value). When the register feeding amount is set in the mixed size mode, the adjusted pulse A2 is added to the feed pulse value A1, and the predetermined pulse value B is added to be the register drive pulse X.

As described above, according to the present invention, the register feeding amount in the mixed size mode in which the originals having differing sizes are transported is set to be larger than that in the normal mode in which the originals having a same size are transported. Therefore, it is possible to securely correct the skew in the originals in the mixed size mode in which it is difficult to regulate the originals with the side regulating plates on the sheet stacking tray. Further, it is possible to correct the skew in the originals having the same size in the normal mode.

While the invention has been explained with reference to the specific embodiments of the invention, the explanation is illustrative and the invention is limited only by the appended claims.

What is claimed is:

1. A sheet supply apparatus for supplying a sheet to a predetermined processing position, comprising:

a sheet supply tray for stacking sheets, sheet feeding means disposed adjacent to the sheet supply tray for feeding the sheets on the sheet supply tray one by one, register means for aligning one of the sheets transferred by the sheet feeding means, a leading end of the sheet abutting against the register means for alignment, setting means for setting a feeding amount of the sheet fed by the sheet feeding means, said setting means setting a first feeding amount that the sheet feeding means feeds the sheet to the register means when the sheets on the sheet supply tray have a same width in a direction perpendicular to a feeding direction of the sheets, and a second feeding amount larger than the first feeding amount when the sheets on the sheet supply tray have different widths, and control means electrically connected to the sheet feeding means and setting means for controlling the sheet feeding means to feed the sheet according to one of the first feeding amount and the second feeding amount set by the setting means.

2. A sheet supply apparatus according to claim 1, further comprising receiving means for receiving a mixed size mode signal when the sheets on the sheet supply tray have the different widths, said setting means setting the second feeding amount when the receiving means receives the mixed size mode signal.

3. A sheet supply apparatus according to claim 2, wherein said setting means sets the first feeding amount when the receiving means does not receive the mixed size mode signal.

4. A sheet supply apparatus according to claim 2, wherein said register means comprises a pair of rollers so that the leading edge of the sheet abuts against a nipping portion of the pair of the rollers.

5. A sheet supply apparatus for supplying a sheet to a predetermined processing position, comprising:

a sheet supply tray for stacking sheets, sheet feeding means disposed adjacent to the sheet supply tray for separating and feeding the sheets on the sheet supply tray, register means for aligning the sheet by abutting against a leading edge of the sheet, detection means arranged between the sheet feeding means and the register means for detecting the leading edge of the sheet, receiving means for receiving a mixed size mode signal when the sheets on the sheet supply tray have different widths in a direction perpendicular to a sheet feed direction, and control means electrically connected to the sheet feeding means, detection means and receiving means for controlling the sheet feeding means to feed the sheet for a predetermined amount and to stop the sheet after the detecting means detects the leading edge of the sheet so that the leading edge of the sheet abuts against the register means, said control means controlling the sheet feeding means to feed the sheet for an amount larger than the predetermined amount when the receiving means receives the mixed size mode signal.

6. A sheet supply apparatus according to claim 5, wherein said control means controls the sheet feeding means to feed the sheet for the amount larger than the predetermined amount by a constant amount when the receiving means receives the mixed size mode signal.

7. A sheet supply apparatus according to claim 5, further comprising selection means installed in an external device for selecting a mixed size mode, said selecting means sending the mixed size mode signal to the receiving means.

8. A sheet supply apparatus according to claim 5, wherein said sheet feeding means includes a draw roller for drawing the sheets from the sheet supply tray, and a feed roller and a separation member which separate and feed the sheets sent from the draw roller, said draw roller, said sheet feed roller and said separation member being disposed substantially at a center in a width direction of the sheet.

9. A sheet supply apparatus according to claim 5, further comprising a pair of side regulating plates disposed on the sheet supply tray for regulating two side edges of the sheet with a center of the sheet as a reference.

10. A sheet supply apparatus for supplying a sheet to a predetermined processing position, comprising:

a sheet supply tray for stacking sheets, sheet feeding means disposed adjacent to the sheet supply tray for separating and feeding the sheets on the sheet supply tray, register means for aligning the sheet by abutting against a leading edge of the sheet, adjusting means for adjusting a feeding amount of the sheet that the sheet feeding means feeds to abut against the register means after the detection means detects the leading edge of the sheet, receiving means for receiving a mixed size mode signal when the sheets on the sheet supply tray have different widths in a direction perpendicular to a sheet feeding direction, and control means electrically connected to the sheet feeding means, adjusting means, and receiving means for controlling the sheet feeding means to feed the sheet, said controlling means feeding the sheet in an amount larger than the feeding amount adjusted by the adjusting means when the receiving means receives the mixed size mode signal.

11. A sheet supply apparatus according to claim 10, further comprising selection means installed in an external device for selecting a mixed size mode to send the mixed size mode signal to the receiving means.

12. A sheet supply apparatus according to claim 10, further comprising input means installed in an external device for inputting adjusting data, said adjusting means adjusting the feeding amount based on the adjusting data.

13. A sheet supply apparatus according to claim 12, wherein said adjusting means calculates the feeding amount according to an original feeding amount and the adjusting data from the input means.

14. A sheet supply apparatus according to claim 10, wherein said control means controls the sheet feeding means to feed the sheet for the amount larger than the feeding amount adjusted by the adjusting means by a constant amount when the receiving means receives the mixed size mode signal.

* * * * *